US010010766B2

(12) United States Patent
Madson

(10) Patent No.: US 10,010,766 B2
(45) Date of Patent: Jul. 3, 2018

(54) SYSTEM AND METHOD FOR COATING GOLF BALLS

(71) Applicant: Acushnet Company, Fairhaven, MA (US)

(72) Inventor: Michael R. Madson, Easton, MA (US)

(73) Assignee: Acushnet Company, Fairhaven, MA (US)

( * ) Notice: Subject to any disclaimer, the term of this patent is extended or adjusted under 35 U.S.C. 154(b) by 58 days.

(21) Appl. No.: 15/183,129

(22) Filed: Jun. 15, 2016

(65) Prior Publication Data

US 2017/0361174 A1 Dec. 21, 2017

(51) Int. Cl.
*A63B 45/00* (2006.01)
*A63B 37/00* (2006.01)
*B05D 3/00* (2006.01)

(52) U.S. Cl.
CPC ..... *A63B 45/00* (2013.01); *A63B 37/0003* (2013.01); *B05D 3/007* (2013.01)

(58) Field of Classification Search
None
See application file for complete search history.

(56) References Cited

U.S. PATENT DOCUMENTS 1,714,994 A * 5/1929 Turner ..... B05C 13/025 118/52
2,833,241 A 5/1958 Crowley et al.
4,425,376 A 1/1984 Lee
4,704,298 A 11/1987 Herman et al.
5,286,532 A * 2/1994 Yoshikawa ..... B29C 59/12 427/536
5,316,739 A * 5/1994 Yoshikawa ..... B29C 59/14 422/186
6,368,658 B1 4/2002 Schwarz et al.
6,706,332 B1 * 3/2004 Lutz ..... A63B 45/00 427/185
8,397,664 B2 * 3/2013 Lin ..... A63B 37/12 118/300
2008/0315469 A1 * 12/2008 Hogge ..... A63B 37/005 264/643
2009/0169741 A1 * 7/2009 Hogge ..... A63B 37/005 427/241

* cited by examiner

*Primary Examiner* — Erma C Cameron
(74) *Attorney, Agent, or Firm* — Margaret C. Barker

(57) ABSTRACT

In a method and related system of the invention, each golf ball component is progressed while being coated, without contacting another surface until after curing, and without the margin for error created in prior systems/methods using physical or air stream up-take supports. In one embodiment, a method of the invention comprises the steps of: progressing a golf ball component within an enclosed chamber for a controlled duration of time; at least partially covering the golf ball component with a coating material while the ball is progressed within the enclosed chamber; and at least partially curing the coating material on golf ball component in the chamber. The golf ball component may be in a state of free fall while progressed within the enclosed chamber, and in some embodiments, also during the step of curing the coating material on the golf ball component.

17 Claims, 2 Drawing Sheets

SYSTEM AND METHOD FOR COATING GOLF BALLS

FIELD OF THE INVENTION

The present invention relates to coating spherical objects such as golf balls, and more particularly, systems and methods for coating same.

BACKGROUND OF THE INVENTION

Golf balls generally comprise a core surrounded by a cover and optionally at least one intermediate layer there between. The cover forms a spherical outer surface and typically includes a plurality of dimples. Any of the core or the cover may incorporate multiple layers and the core may be solid or have a fluid-filled center surrounded by windings or molded material. Golf ball covers may be formed from a variety of materials such as balata, polyurethane, polyurea, thermoplastic compositions and ionomer resins such as SURLYN® and IOTEK®, depending upon the desired performance characteristics of the golf ball and desired properties of the cover.

While golf balls are conventionally white, essentially any desired solid color or pattern can now be provided. Color may be incorporated in the cover material itself or be applied to the cover outer surface as a coating. Typically, in a painted golf ball, a first coat or primer layer of paint is applied, followed by a second, i.e., finishing coat or layer.

It is common for coating to be done via a spray system wherein each golf ball is grasped or otherwise secured by a pronged device and progressed through a spray booth wherein coatings are applied to the golf ball's outer surface. Additionally, robotic systems sometimes pick up the golf balls following coating and transfer them to alternative locations during the curing process. However, this grasping step can result in visually unappealing "pick marks" or defects on the golf ball surface, which can negatively impact a golfer's perception of golf ball quality as well as cause durability issues such as delamination when a club face strikes the golf ball surface.

U.S. Pat. No. 2,833,241 of Crowley et al. ("'241 patent") discloses a method for coating golf balls without using prongs. Each golf ball rolls down a ramp and is picked up by a high velocity air stream that is directed upwardly through an aligned screened section of the ramp as the golf ball arrives at the screened section. The golf ball becomes supported by the air stream while coating material is injected into the air stream to coat the golf ball's surface. However, using this method can produce defects or imperfections in the finished golf ball as well, especially, for example, when the high velocity air stream fails to pick up a golf ball properly or the golf ball is not supported sufficiently within the air stream during coating.

Accordingly, there remains a need for reliable, efficient and cost effective methods and systems for coating a golf ball component without contacting another surface prior to curing the coating material and without the need for a pressurized air stream to up-take and contain the golf ball component during coating. The present inventive method and system for covering a golf ball component with a coating material address and solve these needs.

SUMMARY OF THE INVENTION

Advantageously, in a method and related system of the invention, a golf ball component may be progressed while being covered with a coating material without contacting another surface until after curing and without using a pressurized air or gas stream to up-take and support the golf ball during coating. In one embodiment, a method of the invention comprises the steps of: progressing a golf ball component within an enclosed chamber for a controlled duration of time; at least partially covering the golf ball component with a coating material while the golf ball component is progressed within the enclosed chamber; and at least partially curing the coating material on the golf ball component in the enclosed chamber.

The golf ball component may be in a state of free fall while progressed within the enclosed chamber. In some embodiments, the golf ball component is progressed during the step of curing the coating material on the golf ball component.

The step of progressing the golf ball component may be preceded by a releasing step, wherein the golf ball component is dropped, rolled, injected, or otherwise introduced into the chamber through a top end without contacting an inner surface of the chamber. In another embodiment, the progressing step may be preceded by a releasing step wherein the golf ball component is propelled, launched or otherwise thrust upward into the chamber through a bottom end without contacting the inner surface of the chamber.

The coating material may comprise gas(s), powder(s), liquid(s), or combinations thereof. In one embodiment, the coating material comprises an atomized spray. In some embodiments, the coating material may be selected from the group consisting of thermoset materials, thermoplastic materials, syntactic foams, or combinations thereof. In other embodiments, the coating material may form a primer coat or a finishing coat about the golf ball component. The coating material may also include additives such as Ultra Violet (U.V.) stabilizers, U.V. absorbers, optical brighteners, or combinations thereof.

The coating material covering the golf ball component interacts with the outer surface. In one embodiment, the coating material covers the golf ball component entirely. And in some embodiments, the golf ball component may be subjected to multiple rounds of the coating process. However, embodiments are also envisioned wherein the coating material covers only a portion of the outer surface.

The method may further comprise a step of heating an internal volume of the enclosed chamber to a temperature that softens or melts the coating material but does not soften or melt the golf ball component being covered. Such heating may occur at any time prior to or during the step of at least partially covering the golf ball component with coating material.

In other embodiments, the coating material may be heated directly by a heat source. Heat sources can include, for example, a flame-based heat source, a gas-based heat source, an electrical-based heat source, or combinations thereof. In one embodiment, the heat source does not contact the outer surface of the golf ball component.

In some embodiments, the coating material may be heated to a temperature that softens or melts the coating material but does not soften or melt the golf ball component. In other embodiments, the coating material may be heated to a temperature that softens or melts the coating material and also at least partially softens the golf ball component being covered.

The coating material may be heated directly by the heat source before or after the coating material is introduced into the enclosed chamber. And further, such heating may occur at any time before or during the step of at least partially covering the golf ball component with the coating material.

In one embodiment, the step of at least partially covering the golf ball component with the coating material and the step of at least partially curing the coating material on the golf ball component occur substantially simultaneously. In other embodiments, the step of at least partially covering the golf ball component with the coating material and the step of at least partially curing the coating material on the golf ball component occur at least partially sequentially.

In one embodiment, the step of at least partially curing the coating material on the outer surface may comprise heating the coating material after covering the golf ball component with the coating material. The step of at least partially curing the coating material may in some embodiments comprise exposing the golf ball component to airflow during or after at least partially covering the golf ball component with the coating material. Alternatively or additionally, the step of at least partially curing the coating material may comprise exposing the golf ball component to U.V. light within the chamber at any time during or after the step of at least partially covering the golf ball component with a coating material.

In one embodiment, the coating material may be completely cured on the golf ball component before a coated golf ball component exits the enclosed chamber. In another embodiment, the coating material may be partially cured when a coated golf ball component exits the enclosed chamber, as long as the coating material is fully cured before the coated golf ball component contacts another surface (e.g., is received into packaging, etc.).

The invention is also related to a golf ball comprising at least one golf ball component that is covered with coating material according to the methods and systems disclosed and claimed herein. In this regard, the coating material may for example form any known golf ball layer such as an intermediate layer (outer core layer, casing layer, inner cover layer), outer cover layer, or a coating.

BRIEF DESCRIPTION OF THE DRAWINGS

The accompanying drawings form a part of the specification and are to be read in conjunction therewith. The illustrated embodiments, however, are merely examples and are not intended to be limiting. Like reference numerals and designations in the various drawings indicate like elements.

DETAILED DESCRIPTION

Advantageously, in a method and related system of the invention, a multitude of golf ball components can proceed within a chamber that is shaped and sized to receive and progress each golf ball component while it is covered with a coating material, and wherein the coating material is cured before the golf ball component contacts another surface.

As used herein, the phrase "golf ball component" refers to any golf ball subassembly (core, cased core, etc.) as well as to a covered or even previously coated golf ball.

Meanwhile, the phrase "coating material" refers to any or all of coatings, paint layers or other golf ball materials that can be formed about a spherical golf ball surface, also including but not limited to films and vapor barrier layers. Thus, the phrase "at least partially covering the golf ball component with a coating material", as used herein, may include, for example, applying a coating, paint, film or other layer onto and about the outer surface of the golf ball component.

And the terms "progressing" or "progressed", as used herein, refer to the golf ball component advancing through the chamber without being fully supported physically or by a stream of air or gas. For example, free fall of each golf ball component can occur within the chamber. Examples are envisioned wherein the enclosed chamber may be evacuated, or contain an inert gas. And in some embodiments, a drag shield may be used in the enclosed chamber in order to reduce air drag. The depth of the enclosed chamber can sometimes determine the duration of free fall produced within the enclosed chamber.

Figure 1:
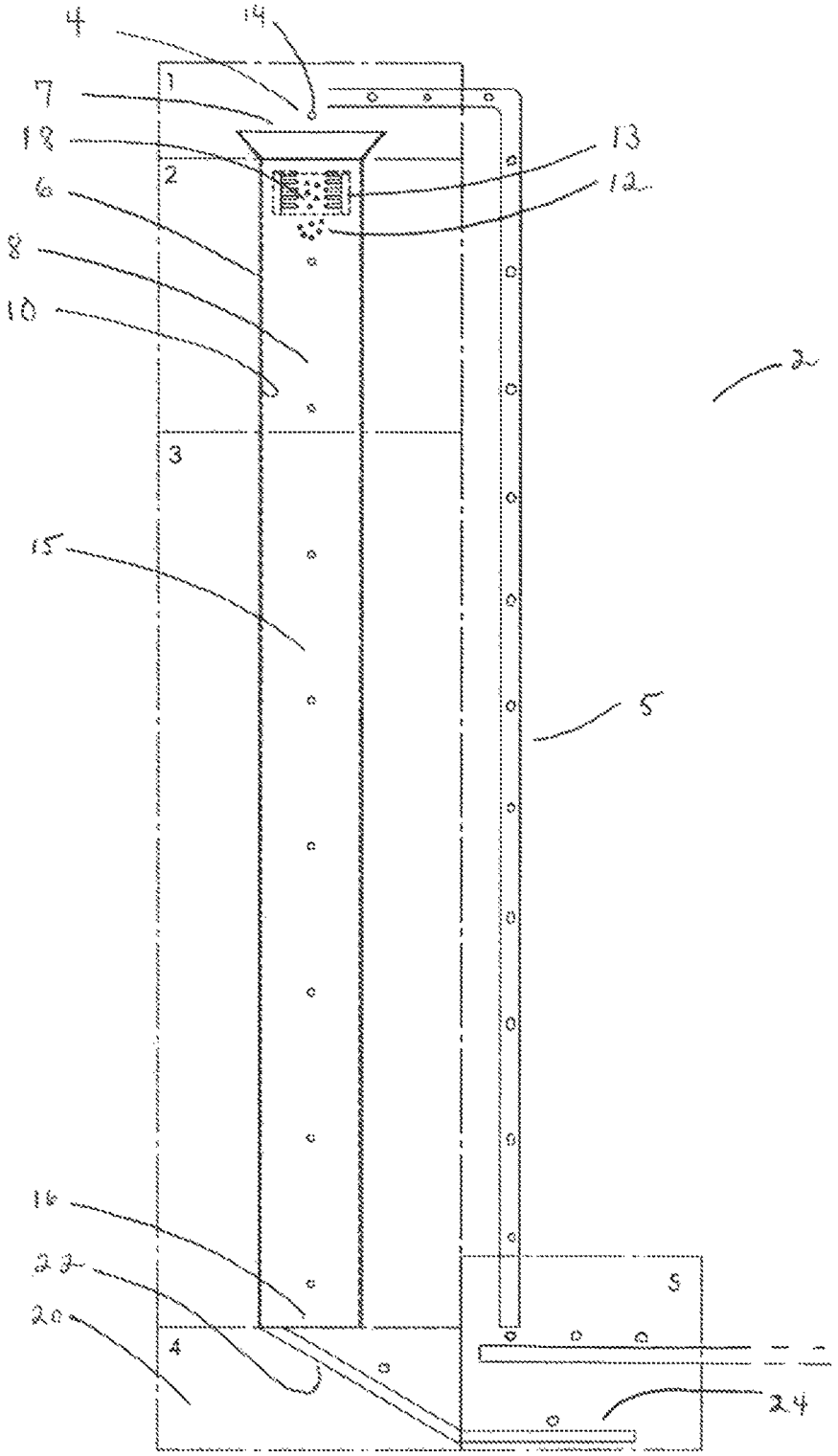
FIG. 1 is a pictorial view of one embodiment of a system of the invention.
Figure 2:
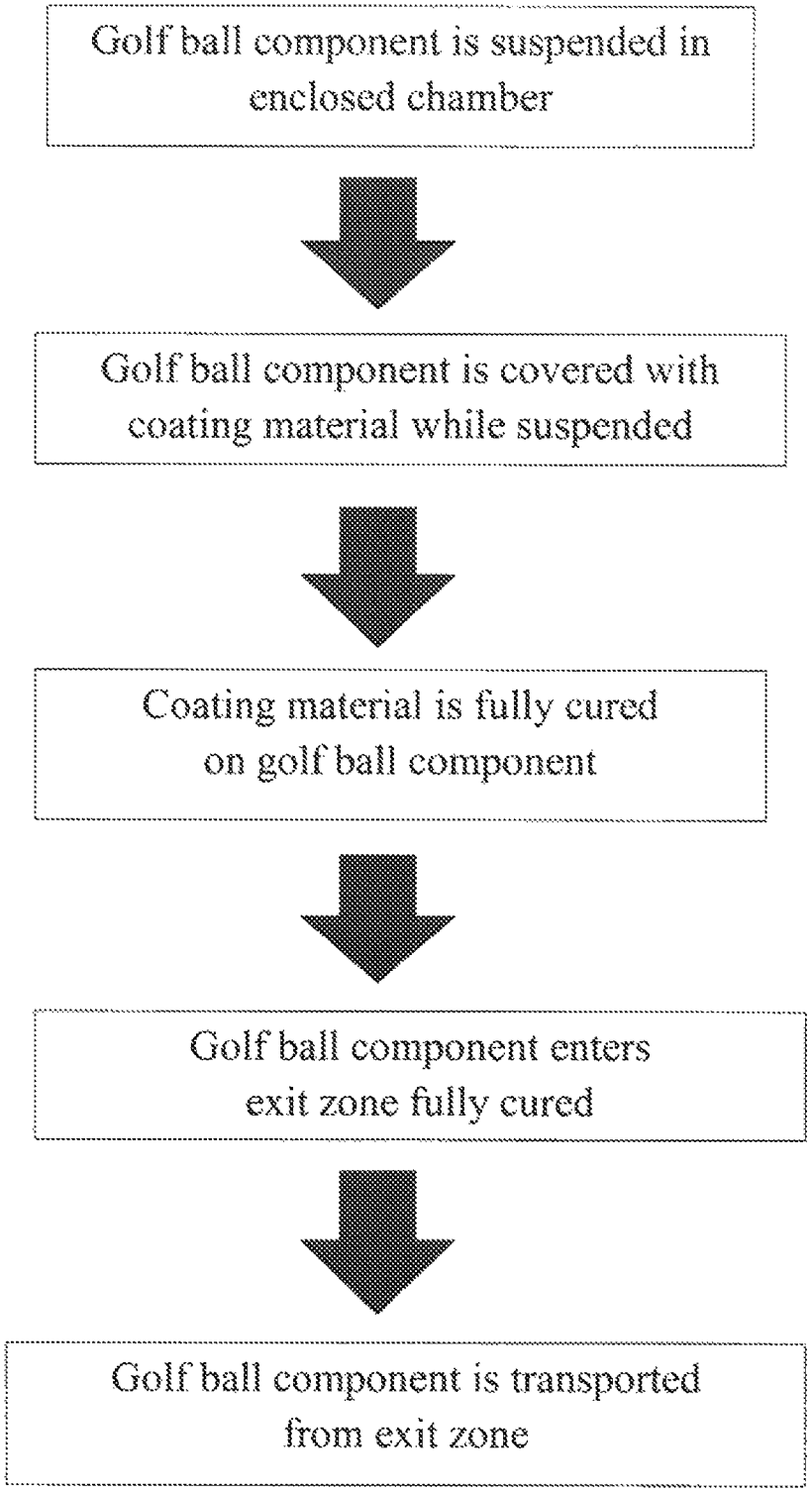
FIG. 2 is a flow chart depicting the steps of one embodiment of a method of the invention.

In one embodiment, the method of the invention can be used in a device such as system 2 of FIG. 1, wherein each of a plurality of golf ball components 4 is loaded and released via transport 5 into tube 6 at top end 7. Embodiments are also contemplated wherein golf ball components 4 are loaded and propelled or otherwise injected upward through bottom end 16 before descending within enclosed chamber 8. In the latter embodiment, embodiments are also envisioned wherein each golf ball component 4 can be coated with a coating material 12 during both ascent and descent within enclosed chamber 8.

Regardless, each golf ball component 4 is progressed in vertical enclosed chamber 8 for a controlled duration of time, during which golf ball component 4 is at least partially covered with coating material 12 (e.g. in zone 2). Thus, each golf ball component 4 progresses downward within substantially vertical enclosed chamber 8 without contacting inner surface 10 while being covered by coating material 12 via spray guns 13 and while coating material 12 is at least partially cured onto outer surface 14. In one embodiment, a known spin may be applied to the golf ball component at least while it is covered with coating material 12.

The step of at least partially covering golf ball component 4 with coating material 12 and the step of at least partially curing coating material 12 onto golf ball component 4 can be sequential. For example, the step of at least partially covering golf ball component 4 with coating material 12 can occur in zone 2, while curing occurs within curing chamber 15 of zone 3. Alternatively, the steps of at least partially covering golf ball component 4 with coating material 12 and at least partially curing coating material 12 onto golf ball component 4 can occur substantially simultaneously.

The step of progressing golf ball component 4 may be preceded by a releasing step, wherein the golf ball component 4 is dropped, rolled, injected, or otherwise introduced into vertical enclosed chamber 8 through a top end 7 without contacting inner surface 10. In another embodiment not depicted in FIG. 1, the releasing step may comprise propelling, launching, or otherwise thrusting golf ball component 4 upward within vertical enclosed chamber 8 through bottom end 16 without contacting inner surface 10.

Coating material 12 may comprise gas(s), powder(s), liquid(s), or combinations thereof. In one embodiment, the coating material comprises an atomized spray. In another non-limiting embodiment, coating material 12 may be selected from the group consisting of thermoset materials, thermoplastic materials, syntactic foams, or combinations thereof. In yet another non-limiting embodiment, coating material 12 may also include additives such as Ultra Violet (U.V.) stabilizers, U.V. absorbers, optical brighteners, or combinations thereof.

In some embodiments, coating material 12 covers golf ball component 4 entirely. However, embodiments are also envisioned wherein coating material 12 covers only a portion of outer surface 14.

In system 2 of FIG. 1, coating material 12 may be provided by spray guns 13 as golf ball component 4 progresses past spray guns 13 within enclosed chamber 8. However, embodiments are also envisioned wherein coating material 12 is provided into enclosed chamber 8 through apertures that extend through inner surface 10 of vertical enclosed chamber 8. Alternatively or additionally, coating material 12 may be released into the top end 7 of enclosed chamber 8 and onto outer surface 14. In some embodiments spray guns 13 may be statically positioned at various locations in the tube to ensure complete coverage of the coating material on the entire surface of golf ball component 4. In other embodiments, spray guns 13 may be mounted on a track system driven, for example, by servo motors which enable spray guns 13 to move and maintain a position relative to golf ball component 4. It is also contemplated that a vision system or light gate can be included preceding spray guns 13 which can calculate any of the velocity or acceleration of golf ball component 4 and program spray guns 13 to provide coating material 12 onto golf ball component 4 according to those measurements.

And embodiments are also envisioned wherein coating material 12 is provided through bottom end 16 into enclosed chamber 8. And in some embodiments, coating material 12 can be at least partially provided onto outer surface 14 during both ascent of golf ball component 4 (following release of golf ball component 4 into enclosed chamber 8 through bottom end 16) and during subsequent free fall of golf ball component 4 within enclosed chamber 8, especially in those embodiments wherein coating material 12 cures substantially simultaneously with being provided onto outer surface 14.

Coating material 12 may form a primer coat or a finishing coat about golf ball component 4. However coating material 12 may form any or all known golf ball layers such as an intermediate layer (outer core layer, casing layer, inner cover layer), or outer cover layer). In one embodiment, coating material 12 may form a moisture barrier layer about outer surface 14. In another embodiment, coating material 12 may form a film about outer surface 14, which may or may not be a moisture barrier layer.

Heat can be provided into system 2 at any time prior to, during, or after the step of covering golf ball component 4 with coating material 12. In one embodiment, an internal volume of vertical enclosed chamber 8 may be heated to a temperature that softens/melts coating material 12 without softening/melting golf ball component 4 prior to and during the step of at least partially covering golf ball component 4 with coating material 12. Or, coating material 12 can be heated within spray guns 13 to a temperature that softens/melts coating material 12 but would not soften/melt the golf ball component 4 and then applied to outer surface 14.

Non-limiting examples of suitable heat sources for heating include flame-based heat sources, gas-based heat sources, electrical-based heat sources, or combinations thereof. Preferably, the heat source never directly contacts outer surface 14 of golf ball component 4.

Coating material 12 interacts with outer surface 14, and strong bonds and excellent adhesive strength results there between when coating material 12 is cured. Curing of coating material 12 can occur in zone 3, or in zones 2 and 3, and in some embodiments, solely in zone 2, depending on the coating material used for example, quick cure formulations, etc.

Airflow may be provided to golf ball component 4 during or after at least partially covering the golf ball component 4 with coating material 12. For example, introducing airflow across at least portions of the enclosed chamber may accelerate curing of coating material 12 on golf ball component 4. Alternatively or additionally, the step of curing the coating material 12 may comprise exposing golf ball component 4 to U.V. light within enclosed chamber at any time during or after the step of at least partially covering the golf ball component 4 with coating material 12. In one embodiment, fans may be included to aid in cure of coating material 12 on golf ball component 4.

In some embodiments, coating material 12 will be completely cured when golf ball component 4 exits enclosed chamber 8. However, in other embodiments, curing of coating material 12 on golf ball component 4 may continue after a coated golf ball component 4 exits enclosed chamber 8, as long as curing is complete when coated golf ball component 4 contacts another surface—for example, when the coated golf ball component is received into packaging, etc.

Following curing, golf ball component 4 may be received into exit zone 20 (zone 4) of FIG. 1 which can include receiving lane 22 comprising for example netting, foam, a flotation liquid, or combinations thereof suitable for receiving coated golf ball component 4. Each coated golf ball component 4 is then transferred to transport 24 (zone 5) for packaging or further processing/construction.

Although system 2 of FIG. 1 contains/displays five zones, embodiments are envisioned wherein enclosed chamber 8 in system 2 consists of a single zone wherein all steps of a method of the invention may be performed. Embodiments are also envisioned wherein system 2 may consist of fewer than five separate zones, and in some embodiments, system 2 may even consist of greater than five zones, if desired.

In some embodiments, releasing golf ball component 4 and free fall thereof can be at least partially coextensive. Meanwhile, free fall of golf ball component 4 and at least partially covering golf ball component 4 with coating material 12 can be at least partially coextensive. Furthermore, at least partially covering golf ball component 4 with coating material 12 and curing coating material 12 on outer surface 14 of golf ball component 4 can be at least partially coextensive. Or, the steps of releasing golf ball component 4, free fall of golf ball component 4, at least partially covering golf ball component 4 with coating material 12, and curing can all be at least partially coextensive.

In some embodiments, at least two steps may be performed sequentially, while in other embodiments, at least two steps will be performed simultaneously. And sequentially performed steps may in some embodiments all occur within a single zone, depending on the coating material used for example.

And it should be understood that enclosed chamber 8 is but one constructional design of the many different ways that a golf ball can be provided, progressed, coated, cured and received/exited without contacting another surface and without being physically supported or otherwise supported by an air stream, etc. and extends to all equivalents.

The method and system of the invention may be used to incorporate at least one of a thermoplastic or thermoset layer about a golf ball component. For example, a heated fluid (e.g. air) can surround and mix with a stream of polymeric particles, forming a heated mixture wherein polymeric particles soften, melt, or otherwise begin reacting. See e.g., co-owned U.S. patent application Ser. No. 14/819,511 of Hebert, hereby incorporated herein in its entirety. Such a heated mixture may then be propelled onto the surface.

A wide range of thermoplastics/ionomers, thermosets, engineered coatings, and syntactic foams can be applied in any desired thicknesses onto a golf ball substrate surface. In this regard, the term interaction refers to crosslinking, fusion, for example and extends to any known mechanism for creating strong adhesion or bonding between golf ball layers. With thermoplastic subassemblies or substrates in particular, the coating material being sprayed should have a softening/melting/reacting temperature that is less than that of the thermoplastic substrate/subassembly to prevent damage to or undesirable modification of the substrate/subassembly onto which the coating is being formed.

Multiple differing heated mixtures may be propelled onto the outer surface 14 as well to form a resulting heterogeneous coating about outer surface 14 comprised of differing materials such as two differing polymeric particles—all without contacting another surface before cure. Many desired golf ball characteristics can easily be achieved by modifying and coordinating any or all of the following: the relative amounts of differing polymeric particles mixed with heated fluids; the relative pressures/speeds with which the different heated mixtures are propelled onto outer surface 14; and how golf ball component 4 is progressed within system 2, i.e. free fall; or by how applicators 13 are positioned with respect to outer surface 14 while the differing heated mixtures are propelled onto outer surface 14.

In one non-limiting embodiment, the chamber may be evacuated. In another non-limiting embodiment, the enclosed chamber may contain an inert gas.

A golf ball of the invention incorporating at least one golf ball component covered with coating material as disclosed and claimed herein may otherwise have any known construction (e.g., inner core layer, intermediate core layer, inner cover layer, outer cover layer, etc.), with each other layer comprising any known golf ball material such as ionomers, polyurethanes, polyureas, polyurethane-polyurea hybrids, TPE, HNP, crosslinked rubber, etc., or blends/mixtures/combinations thereof. And the coated golf ball component may be incorporated into any known construction via any known golf ball manufacturing process for forming additional layers.

In this regard, suitable additional layer compositions are disclosed, for example, in U.S. Pat. Nos. 6,953,820 and 6,939,907, and U.S. Pat. Nos. 5,919,100, 6,653,382, 6,872,774, 7,074,137, and 7,300,364, the entire disclosures of which are hereby incorporated herein by reference.

Suitable rubber compositions include a base rubber selected from natural and synthetic rubbers, including, but not limited to, polybutadiene, polyisoprene, ethylene propylene rubber ("EPR"), ethylene propylene diene rubber ("EPDM"), styrene butadiene rubber, styrenic block copolymer rubber, butyl rubber, halobutyl rubber, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polystyrene elastomers, polyethylene elastomers, polyurethane elastomers, polyurea elastomers, metallocene-catalyzed elastomers and plastomers, polyalkenamer, phenol formaldehyde, melamine formaldehyde, polyepoxide, polysiloxane, alkyd, polyisocyanurate, polycyanurate, polyacrylate, and combinations of two or more thereof. Diene rubbers are preferred, particularly polybutadiene, styrene butadiene, acrylonitrile butadiene, and mixtures of polybutadiene with other elastomers wherein the amount of polybutadiene present greater than 40 wt % based on the total polymeric weight of the mixture.

Non-limiting examples of suitable commercially available base rubbers are Buna CB high-cis neodymium-catalyzed polybutadiene rubbers, such as Buna CB 23, Buna CB24, and Buna CB high-cis cobalt-catalyzed polybutadiene rubbers, such as Buna CB 1203, 1220 and 1221, commercially available from Lanxess Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; Neodene high-cis neodymium-catalyzed polybutadiene rubbers, such as Neodene BR 40, commercially available from Karbochem; TP-301 transpolyisoprene, commercially available from Kuraray Co., Ltd.; Vestenamer® polyoctenamer, commercially available from Evonik Industries; Butyl 065 and Butyl 288 butyl rubbers, commercially available from ExxonMobil Chemical Company; Butyl 301 and Butyl 101-3, commercially available from Lanxess Corporation; Bromobutyl 2224 and Chlorobutyl 1066 halobutyl rubbers, commercially available from ExxonMobil Chemical Company; Bromobutyl X2 and Chlorobutyl 1240 halobutyl rubbers, commercially available from Lanxess Corporation; BromoButyl 2255 butyl rubber, commercially available from Japan Synthetic Rubber Co., Ltd.; Vistalon® 404 and Vistalon® 706 ethylene propylene rubbers, commercially available from ExxonMobil Chemical Company; Dutral CO 058 ethylene propylene rubber, commercially available from Polimeri Europa; Nordel® IP NDR 5565 and Nordel® IP 3670 ethylene-propylene-diene rubbers, commercially available from The Dow Chemical Company; EPT1045 and EPT1045 ethylene-propylene-diene rubbers, commercially available from Mitsui Corporation; Buna SE 1721 TE styrene-butadiene rubbers, commercially available from Lanxess Corporation; Afpol 1500 and Afpol 552 styrene-butadiene rubbers, commercially available from Karbochem; Plioflex PLF 1502, commercially available from Goodyear Chemical; Nipol® DN407 and Nipol® 1041L acrylonitrile butadiene rubbers, commercially available from Zeon Chemicals, L.P.; Neoprene GRT and Neoprene AD30 polychloroprene rubbers; Vamac® ethylene acrylic elastomers, commercially available from E. I. du Pont de Nemours and Company; Hytemp® AR12 and AR214 alkyl acrylate rubbers, commercially available from Zeon Chemicals, L.P.; Hypalon® chlorosulfonated polyethylene rubbers, commercially available from E. I. du Pont de Nemours and Company; and Goodyear Budene® 1207 polybutadiene, commercially available from Goodyear Chemical. In a particular embodiment, the core is formed from a rubber composition comprising as the base rubber a blend of Neodene BR 40 polybutadiene, Budene® 1207 polybutadiene, and Buna SB 1502 styrene butadiene rubber. In another particular embodiment, the core is formed from a rubber composition comprising as the base rubber a blend of Neodene BR 40 polybutadiene, Buna CB 1221, and core regrind.

The rubber is crosslinked using, for example, a peroxide or sulfur cure system, C—C initiators, high energy radiation sources capable of generating free radicals, or a combination thereof. The rubber composition optionally includes one or more of the following: scorch retarder, antioxidant, soft and fast agent, filler, processing aid, processing oil, coloring agent, fluorescent agent, chemical blowing and foaming agent, defoaming agent, stabilizer, softening agent, impact modifier, free radical scavenger, and antiozonant (e.g., p-phenylenediames). Suitable types and amounts of rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Pat. No. 7,654,918, the entire disclosure of which is hereby incorporated herein by reference.

And suitable thermoplastic materials for these other golf ball layers include for example ionomers (more specifically HNP type ionomers as described for example in U.S. Pat. No. 7,867,106) and non-ionomeric materials such as polyether-esters and polyester-amides, or blends thereof. Additional suitable compositions for these other layers are disclosed, for example, in U.S. Pat. Nos. 6,953,820 and 6,939,907, and U.S. Pat. Nos. 5,919,100, 6,653,382, 6,872,774, 7,074,137, and 7,300,364, the entire disclosures of which are hereby incorporated herein by reference.

Suitable ionomer compositions include partially neutralized ionomers and highly neutralized ionomers, including ionomers formed from blends of two or more partially neutralized ionomers, blends of two or more highly neutralized ionomers, and blends of one or more partially neutralized ionomers with one or more highly neutralized ionomers. Preferred ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. As used herein, "(meth) acrylic acid" means methacrylic acid and/or acrylic acid. Likewise, "(meth) acrylate" means methacrylate and/or acrylate. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Particularly preferred O/X/Y-type copolymers are ethylene/(meth) acrylic acid/n-butyl (meth) acrylate, ethylene/(meth) acrylic acid/isobutyl (meth) acrylate, ethylene/(meth) acrylic acid/methyl (meth) acrylate, and ethylene/(meth) acrylic acid/ethyl (meth) acrylate. The acid is typically present in the acid copolymer in an amount of 6 wt % or greater, or 9 wt % or greater, or 10 wt % or greater, or 11 wt % or greater, or 15 wt % or greater, or 16 wt % or greater, or 19 wt % or greater, or 20 wt % or greater, or in an amount within a range having a lower limit of 1 or 4 or 6 or 8 or 10 or 11 or 12 or 15 wt % and an upper limit of 15 or 16 or 17 or 19 or 20 or 20.5 or 21 or 25 or 30 or 35 or 40 wt %, based on the total weight of the acid copolymer. The acid copolymer is at least partially neutralized with a cation source, optionally in the presence of a high molecular weight organic acid, such as those disclosed in U.S. Pat. No. 6,756,436, the entire disclosure of which is hereby incorporated herein by reference. In a particular embodiment, less than 40% of the acid groups present in the composition are neutralized. In another particular embodiment, from 40% to 60% of the acid groups present in the composition are neutralized. In another particular embodiment, from 60% to 70% of the acid groups present in the composition are neutralized. In another particular embodiment, from 60% to 80% of the acid groups present in the composition are neutralized. In another particular embodiment, from 70% to 80% of the acid groups present in the composition are neutralized. In another embodiment, from 80% to 100% of the acid groups present in the composition are neutralized. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, tin, lithium, and rare earth metals. In a particular embodiment, the ionomer composition includes a bimodal ionomer, for example, DuPont® AD1043 ionomers, and the ionomers disclosed in U.S. Pat. No. 7,037,967 and U.S. Pat. Nos. 6,562,906, 6,762,246 and 7,273,903, the entire disclosures of which are hereby incorporated herein by reference. Suitable ionomers are further disclosed, for example, in U.S. Pat. Nos. 5,587,430, 5,691,418, 5,866,658, 6,100,321, 6,653,382, 6,756,436, 6,777,472, 6,815,480, 6,894,098, 6,919,393, 6,953,820, 6,994,638, 7,230,045, 7,375,151, 7,429,624, and 7,652,086, the entire disclosures of which are hereby incorporated herein by reference.

Suitable ionomer compositions also include blends of one or more partially- or fully-neutralized polymers with additional thermoplastic and thermoset materials, including, but not limited to, non-ionomeric acid copolymers, engineering thermoplastics, fatty acid/salt-based highly neutralized polymers, polybutadienes, polyurethanes, polyureas, polyesters, polyamides, polycarbonate/polyester blends, thermoplastic elastomers, maleic anhydride-grafted metallocene-catalyzed polymers (e.g., maleic anhydride-grafted metallocene-catalyzed polyethylene), and other conventional polymeric materials.

Suitable ionomeric compositions are further disclosed, for example, in U.S. Pat. Nos. 6,653,382, 6,756,436, 6,777,472, 6,894,098, 6,919,393, and 6,953,820, the entire disclosures of which are hereby incorporated herein by reference.

Also suitable are polyester ionomers, including, but not limited to, those disclosed, for example, in U.S. Pat. Nos. 6,476,157 and 7,074,465, the entire disclosures of which are hereby incorporated herein by reference.

Also suitable are thermoplastic elastomers comprising a silicone ionomer, as disclosed, for example, in U.S. Pat. No. 8,329,156, the entire disclosure of which is hereby incorporated herein by reference.

Also suitable are the following non-ionomeric polymers, including homopolymers and copolymers thereof, as well as their derivatives that are compatibilized with at least one grafted or copolymerized functional group, such as maleic anhydride, amine, epoxy, isocyanate, hydroxyl, sulfonate, phosphonate, and the like:

(a) polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly (ethylene naphthenate), and those disclosed in U.S. Pat. Nos. 6,353,050, 6,274,298, and 6,001,930, the entire disclosures of which are hereby incorporated herein by reference, and blends of two or more thereof;

(b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof;

(c) polyurethanes, polyureas, polyurethane-polyurea hybrids, and blends of two or more thereof;

(d) fluoropolymers, such as those disclosed in U.S. Pat. Nos. 5,691,066, 6,747,110 and 7,009,002, the entire disclosures of which are hereby incorporated herein by reference, and blends of two or more thereof;

(e) non-ionomeric acid polymers, such as E/X- and E/X/Y-type copolymers, wherein E is an olefin (e.g., ethylene), X is a carboxylic acid such as acrylic, methacrylic, crotonic, maleic, fumaric, or itaconic acid, and Y is an optional softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof;

(f) metallocene-catalyzed polymers, such as those disclosed in U.S. Pat. Nos. 6,274,669, 5,919,862, 5,981,654, and 5,703,166, the entire disclosures of which are hereby incorporated herein by reference, and blends of two or more thereof;

(g) polystyrenes, such as poly(styrene-co-maleic anhydride), acrylonitrile-butadiene-styrene, poly(styrene sulfonate), polyethylene styrene, and blends of two or more thereof;

(h) polypropylenes and polyethylenes, particularly grafted polypropylene and grafted polyethylenes that are modified with a functional group, such as maleic anhydride of sulfonate, and blends of two or more thereof;

(i) polyvinyl chlorides and grafted polyvinyl chlorides, and blends of two or more thereof;

(j) polyvinyl acetates, preferably having less than about 9% of vinyl acetate by weight, and blends of two or more thereof;

(k) polycarbonates, blends of polycarbonate/acrylonitrile-butadiene-styrene, blends of polycarbonate/polyurethane, blends of polycarbonate/polyester, and blends of two or more thereof;

(l) polyvinyl alcohols, and blends of two or more thereof;

(m) polyethers, such as polyarylene ethers, polyphenylene oxides, block copolymers of alkenyl aromatics with vinyl aromatics and poly(amic ester)s, and blends of two or more thereof;

(n) polyimides, polyetherketones, polyamideimides, and blends of two or more thereof;

(o) polycarbonate/polyester copolymers and blends; and (p) combinations of any two or more of the above thermoplastic polymers.

In general, polyurea compositions contain urea linkages formed by reacting an isocyanate group (—N═C═O) with an amine group (NH or $NH_2$). The chain length of the polyurea prepolymer is extended by reacting the prepolymer with an amine curing agent. The resulting polyurea has elastomeric properties, because of its "hard" and "soft" segments, which are covalently bonded together. The soft, amorphous, low-melting point segments, which are formed from the polyamines, are relatively flexible and mobile, while the hard, high-melting point segments, which are formed from the isocyanate and chain extenders, are relatively stiff and immobile. The phase separation of the hard and soft segments provides the polyurea with its elastomeric resiliency. The polyurea composition contains urea linkages having the following general structure:

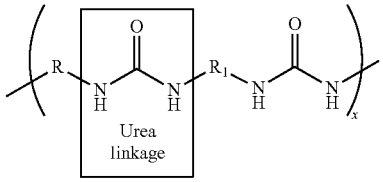

where x is the chain length, i.e., about 1 or greater, and R and $R_1$ are straight chain or branched hydrocarbon chains having about 1 to about 20 carbon atoms.

Meanwhile, a polyurea/polyurethane hybrid composition is produced when the polyurea prepolymer (as described above) is chain-extended using a hydroxyl-terminated curing agent. Any excess isocyanate groups in the prepolymer will react with the hydroxyl groups in the curing agent and create urethane linkages. That is, a polyurea/polyurethane hybrid composition is produced.

In a preferred embodiment, a pure polyurea composition, as described above, is prepared. That is, the composition contains only urea linkages. An amine-terminated curing agent is used in the reaction to produce the pure polyurea composition. However, it should be understood that a polyurea/polyurethane hybrid composition also may be prepared in accordance with this invention as discussed above. Such a hybrid composition can be formed if the polyurea prepolymer is cured with a hydroxyl-terminated curing agent. Any excess isocyanate in the polyurea prepolymer reacts with the hydroxyl groups in the curing agent and forms urethane linkages. The resulting polyurea/polyurethane hybrid composition contains both urea and urethane linkages. The general structure of a urethane linkage is shown below:

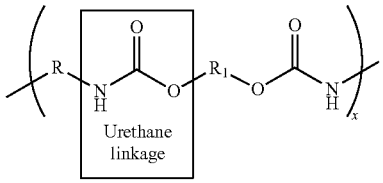

where x is the chain length, i.e., about 1 or greater, and R and $R_1$ are straight chain or branched hydrocarbon chains having about 1 to about 20 carbon atoms.

Two techniques for making the polyurea and polyurea/urethane compositions include: a) one-shot technique, and b) prepolymer technique. In the one-shot technique, the isocyanate blend, polyamine, and hydroxyl and/or amine-terminated curing agent are reacted in one step. On the other hand, the prepolymer technique involves a first reaction between the isocyanate blend and polyamine to produce a polyurea prepolymer, and a subsequent reaction between the prepolymer and hydroxyl and/or amine-terminated curing agent. As a result of the reaction between the isocyanate and polyamine compounds, there will be some unreacted NCO groups in the polyurea prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

Either the one-shot or prepolymer method may be employed to produce the polyurea and polyurea/urethane compositions; however, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

In the casting process, the polyurea and polyurea/urethane compositions can be formed by chain-extending the polyurea prepolymer with a single curing agent or blend of curing agents as described further below. The compositions of the present invention may be selected from among both castable thermoplastic and thermoset materials. Thermoplastic polyurea compositions are typically formed by reacting the isocyanate blend and polyamines at a 1:1 stoichiometric ratio. Thermoset compositions, on the other hand, are cross-linked polymers and are typically produced from the reaction of the isocyanate blend and polyamines at normally a 1.05:1 stoichiometric ratio. In general, thermoset polyurea compositions are easier to prepare than thermoplastic polyureas.

The polyurea prepolymer can be chain-extended by reacting it with a single curing agent or blend of curing agents (chain-extenders). In general, the prepolymer can be reacted with hydroxyl-terminated curing agents, amine-terminated curing agents, or mixtures thereof. The curing agents extend the chain length of the prepolymer and build-up its molecular weight. Normally, the prepolymer and curing agent are mixed so the isocyanate groups and hydroxyl or amine groups are mixed at a 1.05:1.00 stoichiometric ratio.

A catalyst may be employed to promote the reaction between the isocyanate and polyamine compounds for producing the prepolymer or between prepolymer and curing agent during the chain-extending step. Preferably, the catalyst is added to the reactants before producing the prepolymer. Suitable catalysts include, but are not limited to, bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition.

The hydroxyl chain-extending (curing) agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy) ethoxy]ethoxy}cyclohexane; trimethylolpropane; polytetramethylene ether glycol (PTMEG), preferably having a molecular weight from about 250 to about 3900; and mixtures thereof.

Suitable amine chain-extending (curing) agents that can be used in chain-extending the polyurea prepolymer of this invention include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"), 4,4'-bis(sec-butylamino)-diphenylmethane, N,N'-dialkylamino-diphenylmethane, trimethyleneglycol-di(p-aminobenzoate), polyethyleneglycol-di(p-aminobenzoate), polytetramethyleneglycol-di(p-aminobenzoate); saturated diamines such as ethylene diamine, 1,3-propylene diamine, 2-methyl-pentamethylene diamine, hexamethylene diamine, 2,2,4- and 2,4,4-trimethyl-1,6-hexane diamine, imino-bis(propylamine), imido-bis(propylamine), methylimino-bis(propylamine) (i.e., N-(3-aminopropyl)-N-methyl-1,3-propanediamine), 1,4-bis(3-aminopropoxy)butane (i.e., 3,3'-[1,4-butanediyl-bis-(oxy)bis]-1-propanamine), diethyleneglycol-bis(propylamine) (i.e., diethyleneglycol-di(aminopropyl)ether), 4,7,10-trioxatridecane-1,13-diamine, 1-methyl-2,6-diamino-cyclohexane, 1,4-diamino-cyclohexane, poly(oxyethylene-oxypropylene) diamines, 1,3- or 1,4-bis(methylamino)-cyclohexane, isophorone diamine, 1,2- or 1,4-bis(sec-butylamino)-cyclohexane, N,N'-diisopropyl-isophorone diamine, 4,4'-diamino-dicyclohexylmethane, 3,3'-dimethyl-4,4'-diamino-dicyclohexylmethane, 3,3'-dichloro-4,4'-diamino-dicyclohexylmethane, N,N'-dialkylamino-dicyclohexylmethane, polyoxyethylene diamines, 3,3'-diethyl-5,5'-dimethyl-4,4'-diamino-dicyclohexylmethane, polyoxypropylene diamines, 3,3'-diethyl-5,5'-dichloro-4,4'-diamino-dicyclohexylmethane, polytetramethylene ether diamines, 3,3',5,5 '-tetraethyl-4,4'-diamino-dicyclohexylmethane (i.e., 4,4'-methylene-bis(2,6-diethylaminocyclohexane)), 3,3'-dichloro-4,4'-diamino-dicyclohexylmethane, 2,2'-dichloro-3,3',5,5'-tetraethyl-4,4'-diamino-dicyclohexylmethane, (ethylene oxide)-capped polyoxypropylene ether diamines, 2,2',3,3'-tetrachloro-4,4'-diamino-dicyclohexylmethane, 4,4'-bis(sec-butylamino)-dicyclohexylmethane; triamines such as diethylene triamine, dipropylene triamine, (propylene oxide)-based triamines (i.e., polyoxypropylene triamines), N-(2-aminoethyl)-1,3-propylenediamine (i.e., $N_3$-amine), glycerin-based triamines, (all saturated); tetramines such as N,N'-bis(3-aminopropyl)ethylene diamine (i.e., $N_4$-amine) (both saturated), triethylene tetramine; and other polyamines such as tetraethylene pentamine (also saturated). One suitable amine-terminated chain-extending agent is Ethacure 300™ (dimethylthiotoluenediamine or a mixture of 2,6-diamino- 3,5-dimethylthiotoluene and 2,4-diamino-3,5-dimethylthiotoluene.) The amine curing agents used as chain extenders normally have a cyclic structure and a low molecular weight (250 or less).

When the polyurea prepolymer is reacted with amine-terminated curing agents during the chain-extending step, as described above, the resulting composition is essentially a pure polyurea composition. On the other hand, when the polyurea prepolymer is reacted with a hydroxyl-terminated curing agent during the chain-extending step, any excess isocyanate groups in the prepolymer will react with the hydroxyl groups in the curing agent and create urethane linkages to form a polyurea/urethane hybrid.

This chain-extending step, which occurs when the polyurea prepolymer is reacted with hydroxyl curing agents, amine curing agents, or mixtures thereof, builds-up the molecular weight and extends the chain length of the prepolymer. When the polyurea prepolymer is reacted with amine curing agents, a polyurea composition having urea linkages is produced. When the polyurea prepolymer is reacted with hydroxyl curing agents, a polyurea/urethane hybrid composition containing both urea and urethane linkages is produced. The polyurea/urethane hybrid composition is distinct from the pure polyurea composition. The concentration of urea and urethane linkages in the hybrid composition may vary. In general, the hybrid composition may contain a mixture of about 10 to 90% urea and about 90 to 10% urethane linkages. The resulting polyurea or polyurea/urethane hybrid composition has elastomeric properties based on phase separation of the soft and hard segments. The soft segments, which are formed from the polyamine reactants, are generally flexible and mobile, while the hard segments, which are formed from the isocyanates and chain extenders, are generally stiff and immobile.

In an alternative embodiment, at least one layer may be formed from a polyurethane or polyurethane/urea hybrid composition. As discussed above, in general, polyurethane compositions contain urethane linkages formed by reacting an isocyanate group (—N═C═O) with a hydroxyl group (OH). The polyurethanes are produced by the reaction of a multi-functional isocyanate (NCO—R—NCO) with a long-chain polyol having terminal hydroxyl groups (OH—OH) in the presence of a catalyst and other additives. The chain length of the polyurethane prepolymer is extended by reacting it with short-chain diols (OH—R'—OH). The resulting polyurethane has elastomeric properties because of its "hard" and "soft" segments, which are covalently bonded together. This phase separation occurs because the mainly non-polar, low melting soft segments are incompatible with the polar, high melting hard segments. The hard segments, which are formed by the reaction of the diisocyanate and low molecular weight chain-extending diol, are relatively stiff and immobile. The soft segments, which are formed by the reaction of the diisocyanate and long chain diol, are relatively flexible and mobile. Because the hard segments are covalently coupled to the soft segments, they inhibit plastic flow of the polymer chains, thus creating elastomeric resiliency.

Suitable isocyanate compounds that can be used to prepare the polyurethane or polyurethane/urea hybrid material are described above. These isocyanate compounds are able to react with the hydroxyl or amine compounds and form a durable and tough polymer having a high melting point. The resulting polyurethane generally has good mechanical strength and cut/shear-resistance. In addition, the polyurethane composition has good light and thermal-stability.

When forming a polyurethane prepolymer, any suitable polyol may be reacted with the above-described isocyanate blends in accordance with this invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. In still another embodiment, polycaprolactone polyols are included in the materials of the invention. Suitable polycaprolactone polyols include, but are not limited to: 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups. In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

In a manner similar to making the above-described polyurea compositions, there are two basic techniques that can be used to make the polyurethane compositions of this invention: a) one-shot technique, and b) prepolymer technique. In the one-shot technique, the isocyanate blend, polyol, and hydroxyl-terminated and/or amine-terminated chain-extender (curing agent) are reacted in one step. On the other hand, the prepolymer technique involves a first reaction between the isocyanate blend and polyol compounds to produce a polyurethane prepolymer, and a subsequent reaction between the prepolymer and hydroxyl-terminated and/or amine-terminated chain-extender. As a result of the reaction between the isocyanate and polyol compounds, there will be some unreacted NCO groups in the polyurethane prepolymer. The prepolymer should have less than 14% unreacted NCO groups. Preferably, the prepolymer has no greater than 8.5% unreacted NCO groups, more preferably from 2.5% to 8%, and most preferably from 5.0% to 8.0% unreacted NCO groups. As the weight percent of unreacted isocyanate groups increases, the hardness of the composition also generally increases.

Either the one-shot or prepolymer method may be employed to produce the polyurethane compositions of the invention. In one embodiment, the one-shot method is used, wherein the isocyanate compound is added to a reaction vessel and then a curative mixture comprising the polyol and curing agent is added to the reaction vessel. The components are mixed together so that the molar ratio of isocyanate groups to hydroxyl groups is in the range of about 1.01:1.00 to about 1.10:1.00. Preferably, the molar ratio is greater than or equal to 1.05:1.00. For example, the molar ratio can be in the range of 1.05:1.00 to 1.10:1.00. In a second embodiment, the prepolymer method is used. In general, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

The polyurethane compositions can be formed by chain-extending the polyurethane prepolymer with a single curing agent (chain-extender) or blend of curing agents (chain-extenders) as described further below. The compositions of the present invention may be selected from among both castable thermoplastic and thermoset polyurethanes. Thermoplastic polyurethane compositions are typically formed by reacting the isocyanate blend and polyols at a 1:1 stoichiometric ratio. Thermoset compositions, on the other hand, are cross-linked polymers and are typically produced from the reaction of the isocyanate blend and polyols at normally a 1.05:1 stoichiometric ratio. In general, thermoset polyurethane compositions are easier to prepare than thermoplastic polyurethanes.

As discussed above, the polyurethane prepolymer can be chain-extended by reacting it with a single chain-extender or blend of chain-extenders. In general, the prepolymer can be reacted with hydroxyl-terminated curing agents, amine-terminated curing agents, and mixtures thereof. The curing agents extend the chain length of the prepolymer and build-up its molecular weight. Normally, the prepolymer and curing agent are mixed so the isocyanate groups and hydroxyl or amine groups are mixed at a 1.05:1.00 stoichiometric ratio.

A catalyst may be employed to promote the reaction between the isocyanate and polyol compounds for producing the polyurethane prepolymer or between the polyurethane prepolymer and chain-extender during the chain-extending step. Preferably, the catalyst is added to the reactants before producing the polyurethane prepolymer. Suitable catalysts include, but are not limited to, the catalysts described above for making the polyurea prepolymer. The catalyst is preferably added in an amount sufficient to catalyze the reaction of the components in the reactive mixture. In one embodiment, the catalyst is present in an amount from about 0.001 percent to about 1 percent, and preferably 0.1 to 0.5 percent, by weight of the composition. Suitable hydroxyl chain-extending (curing) agents and amine chain-extending (curing) agents include, but are not limited to, the curing agents described above for making the polyurea and polyurea/urethane hybrid compositions. When the polyurethane prepolymer is reacted with hydroxyl-terminated curing agents during the chain-extending step, as described above, the resulting polyurethane composition contains urethane linkages. On the other hand, when the polyurethane prepolymer is reacted with amine-terminated curing agents during the chain-extending step, any excess isocyanate groups in the prepolymer will react with the amine groups in the curing agent. The resulting polyurethane composition contains urethane and urea linkages and may be referred to as a polyurethane/urea hybrid. The concentration of urethane and urea linkages in the hybrid composition may vary. In general, the hybrid composition may contain a mixture of about 10 to 90% urethane and about 90 to 10% urea linkages.

Examples of commercially available thermoplastics suitable for forming thermoplastic layers include, but are not limited to, Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000, HPF 2000, HPF AD 1035, HPF AD 1040, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics.

Suitable plasticized polymer compositions include a plasticizer in an amount sufficient to substantially change the stiffness and/or hardness of the composition, and typically comprise from 20 to 99.5 wt % of the polymer and from 0.5 to 80 wt % of the plasticizer, based on the combined weight of the polymer and the plasticizer. In a particular embodiment, the plasticizer is present in an amount of 0.5% or 1% or 3% or 5% or 7% or 8% or 9% or 10% or 12% or 15% or 18% or 20% or 22% or 25% or 30% or 35% or 40% or 42% or 50% or 55% or 60% or 66% or 71% or 75% or 80%, by weight based on the combined weight of the polymer and the plasticizer, or the plasticizer is present in an amount within a range having a lower limit and an upper limit selected from these values. Suitable polymers include acid copolymers, partially neutralized acid copolymers, highly neutralized acid polymers ("HNPs"), polyesters, polyamides, thermosetting and thermoplastic polyurethanes.

Suitable plasticized acid copolymer compositions, plasticized partially neutralized acid copolymer compositions, and plasticized HNP compositions, and particularly suitable golf ball constructions utilizing such compositions, are further disclosed, for example, in U.S. Patent Application Publ. No. 2015/0031475, U.S. Patent Application Publ. No. 2015/0005108, U.S. patent application Ser. No. 14/576,800, and U.S. patent application Ser. No. 14/588,317, the entire disclosures of which are hereby incorporated herein by reference.

Suitable plasticized polyester compositions, and particularly suitable golf ball constructions utilizing such compositions, are further disclosed, for example, in U.S. patent application Ser. No. 14/532,141, the entire disclosure of which is hereby incorporated herein by reference.

Suitable plasticized polyamide compositions, and particularly suitable golf ball constructions utilizing such compositions, are further disclosed, for example, in U.S. Patent Application Publ. No. 2014/0302947, U.S. Patent Application Publ. No. 2014/0323243, U.S. Patent Application Publ. No. 20150057105, and U.S. patent application Ser. No. 14/576,324, the entire disclosures of which are hereby incorporated herein by reference.

Suitable plasticized polyurethane compositions, and particularly suitable golf ball constructions utilizing such compositions, are further disclosed, for example, in U.S. patent application Ser. No. 14/672,538, U.S. patent application Ser. No. 14/672,523, U.S. patent application Ser. No. 14/672,485, and U.S. patent application Ser. No. 14/691,720, the entire disclosures of which are hereby incorporated herein by reference. Further suitable plasticized compositions include for example those disclosed in U.S. patent application Ser. Nos. 14/571,610, 14/576,324, and 14/707,028.

And it is contemplated that a golf ball of the invention may have any known construction and have any number of layers with any known properties. In one non-limiting example, a golf ball of the invention may comprise a single core having a diameter of from about 1.20 in. to about 1.65 in. Alternatively, the core may have a dual core arrangement having a total diameter of from about 1.40 in. to about 1.65 in, for example, wherein the inner core may has a diameter of from about 0.75 inches to about 1.30 in. and the outer core has a thickness of from about 0.05 in. to about 0.45 in. Cover thicknesses generally range from about 0.015 in. to about 0.090 inches, although a golf ball of the invention may comprise any known thickness. Meanwhile, casing layers and inner cover layers each typically have thicknesses ranging from about 0.01 in. to about 0.06 in. A golf ball of the invention may also have one or more coating layers having a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example.

In some embodiments, the core may have an overall diameter within a range having a lower limit of 0.500 or 0.700 or 0.750 or 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 inches and an upper limit of 1.620 or 1.630 or 1.640 inches. In a particular embodiment, the core is a multi-layer core having an overall diameter within a range having a lower limit of 0.500 or 0.700 or 0.750 or 0.800 or 0.850 or 0.900 or 0.950 or 1.000 or 1.100 or 1.150 or 1.200 inches and an upper limit of 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter within a range having a lower limit of 0.500 or 0.700 or 0.750 inches and an upper limit of 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter of 1.500 inches or 1.510 inches or 1.530 inches or 1.550 inches or 1.570 inches or 1.580 inches or 1.590 inches or 1.600 inches or 1.610 inches or 1.620 inches.

The inner core can have an overall diameter of 0.500 inches or greater, or 0.700 inches or greater, or 1.00 inches or greater, or 1.250 inches or greater, or 1.350 inches or greater, or 1.390 inches or greater, or 1.450 inches or greater, or an overall diameter within a range having a lower limit of 0.250 or 0.500 or 0.750 or 1.000 or 1.250 or 1.350 or 1.390 or 1.400 or 1.440 inches and an upper limit of 1.460 or 1.490 or 1.500 or 1.550 or 1.580 or 1.600 inches, or an overall diameter within a range having a lower limit of 0.250 or 0.300 or 0.350 or 0.400 or 0.500 or 0.550 or 0.600 or 0.650 or 0.700 inches and an upper limit of 0.750 or 0.800 or 0.900 or 0.950 or 1.000 or 1.100 or 1.150 or 1.200 or 1.250 or 1.300 or 1.350 or 1.400 inches. In one embodiment, the inner core consists of a single layer formed from a thermoset rubber composition. In another embodiment, the inner core consists of two layers, each of which is formed from the same or different thermoset rubber compositions. In another embodiment, the inner core comprises three or more layers, each of which is formed from the same or different thermoset rubber compositions. In another embodiment, the inner core consists of a single layer formed from a thermoplastic composition. In another embodiment, the inner core consists of two layers, each of which is formed from the same or different thermoplastic compositions. In another embodiment, the inner core comprises three or more layers, each of which is formed from the same or different thermoplastic compositions.

In a particular embodiment, the overall core of a golf ball of the invention has one or more of the following properties:

a) a geometric center hardness within a range having a lower limit of 20 or 25 or 30 or 35 or 40 or 45 or 50 or 55 Shore C and an upper limit of 60 or 65 or 70 or 75 or less than about 79 Shore C;
b) an outer surface hardness within a range having a lower limit of 80 or 85 or 90 or 95 Shore C;
c) a positive hardness gradient of at least 20 Shore C; and
d) an overall compression of about 75 or greater, or greater than 75, or about 80 or greater, or greater than or 80.

An intermediate core layer can have an overall thickness within a range having a lower limit of 0.005 or 0.010 or 0.015 or 0.020 or 0.025 or 0.030 or 0.035 or 0.040 or 0.045 inches and an upper limit of 0.050 or 0.055 or 0.060 or 0.065 or 0.070 or 0.075 or 0.080 or 0.090 or 0.100 inches. In one embodiment, the intermediate core consists of a single layer formed from a thermoset rubber composition. In another embodiment, the intermediate core consists of two layers, each of which is formed from the same or different thermoset rubber compositions. In another embodiment, the intermediate core comprises three or more layers, each of which is formed from the same or different thermoset rubber compositions. In another embodiment, the intermediate core consists of a single layer formed from a thermoplastic composition. In another embodiment, the intermediate core consists of two layers, each of which is formed from the same or different thermoplastic compositions. In another embodiment, the intermediate core comprises three or more layers, each of which is formed from the same or different thermoplastic compositions.

The outer core layer can have an overall thickness within a range having a lower limit of 0.010 or 0.020 or 0.025 or 0.030 or 0.035 inches and an upper limit of 0.040 or 0.070 or 0.075 or 0.080 or 0.100 or 0.150 inches, or an overall thickness within a range having a lower limit of 0.025 or 0.050 or 0.100 or 0.150 or 0.160 or 0.170 or 0.200 inches and an upper limit of 0.225 or 0.250 or 0.275 or 0.300 or 0.325 or 0.350 or 0.400 or 0.450 or greater than 0.450 inches. The outer core layer may alternatively have a thickness of greater than 0.10 inches, or 0.20 inches or greater, or greater than 0.20 inches, or 0.30 inches or greater, or greater than 0.30 inches, or 0.35 inches or greater, or greater than 0.35 inches, or 0.40 inches or greater, or greater than 0.40 inches, or 0.45 inches or greater, or greater than 0.45 inches, or a thickness within a range having a lower limit of 0.005 or 0.010 or 0.015 or 0.020 or 0.025 or 0.030 or 0.035 or 0.040 or 0.045 or 0.050 or 0.055 or 0.060 or 0.065 or 0.070 or 0.075 or 0.080 or 0.090 or 0.100 or 0.200 or 0.250 inches and an upper limit of 0.300 or 0.350 or 0.400 or 0.450 or 0.500 inches or greater.

The multi-layer core is enclosed with a cover, which may be a single-, dual-, or multi-layer cover, preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In a particular embodiment, the cover is a single layer having a thickness of from 0.010 or 0.020 or 0.025 inches to 0.035 or 0.040 or 0.050 inches. In another particular embodiment, the cover consists of an inner cover layer having a thickness of from 0.010 or 0.020 or 0.025 inches to 0.035 or 0.050 inches and an outer cover layer having a thickness of from 0.010 or 0.020 or 0.025 inches to 0.035 or 0.040 inches.

In one embodiment, the cover is a single layer having a surface hardness of 60 Shore D or greater, or 65 Shore D or greater. In a particular aspect of this embodiment, the cover is formed from a composition having a material hardness of 60 Shore D or greater, or 65 Shore D or greater.

In another particular embodiment, the cover is a single layer having a thickness of from 0.010 or 0.020 inches to 0.035 or 0.050 inches and formed from an ionomeric composition having a material hardness of from 60 or 62 or 65 Shore D to 65 or 70 or 72 Shore D.

In another particular embodiment, the cover is a single layer having a thickness of from 0.010 or 0.025 inches to 0.035 or 0.040 inches and formed from a thermoplastic composition selected from ionomer-, polyurethane-, and polyurea-based compositions having a material hardness of 62 Shore D or less, or less than 62 Shore D, or 60 Shore D or less, or less than 60 Shore D, or 55 Shore D or less, or less than 55 Shore D.

In another particular embodiment, the cover is a single layer having a thickness of from 0.010 or 0.025 inches to 0.035 or 0.040 inches and formed from a thermosetting polyurethane- or polyurea-based composition having a material hardness of 62 Shore D or less, or less than 62 Shore D, or 60 Shore D or less, or less than 60 Shore D, or 55 Shore D or less, or less than 55 Shore D.

In another particular embodiment, the cover comprises an inner cover layer formed from an ionomeric composition and an outer cover layer formed from a thermosetting polyurethane- or polyurea-based composition. The inner cover layer composition preferably has a material hardness of from 60 or 62 or 65 Shore D to 65 or 70 or 72 Shore D. The inner cover layer preferably has a thickness within a range having a lower limit of 0.010 or 0.020 or 0.030 inches and an upper limit of 0.035 or 0.040 or 0.050 inches. The outer cover layer composition preferably has a material hardness of 62 Shore D or less, or less than 62 Shore D, or 60 Shore D or less, or less than 60 Shore D, or 55 Shore D or less, or less than 55 Shore D. The outer cover layer preferably has a thickness within a range having a lower limit of 0.010 or 0.020 or 0.025 inches and an upper limit of 0.035 or 0.040 or 0.050 inches.

In another particular embodiment, the cover comprises an inner cover layer formed from an ionomeric composition and an outer cover layer formed from a thermoplastic composition selected from ionomer-, polyurethane-, and polyurea-based compositions. The inner cover layer composition preferably has a material hardness of from 60 or 62 or 65 Shore D to 65 or 70 or 72 Shore D. The inner cover layer preferably has a thickness within a range having a lower limit of 0.010 or 0.020 or 0.030 inches and an upper limit of 0.035 or 0.040 or 0.050 inches. The outer cover layer composition preferably has a material hardness of 62 Shore D or less, or less than 62 Shore D, or 60 Shore D or less, or less than 60 Shore D, or 55 Shore D or less, or less than 55 Shore D. The outer cover layer preferably has a thickness within a range having a lower limit of 0.010 or 0.020 or 0.025 inches and an upper limit of 0.035 or 0.040 or 0.050 inches.

In another particular embodiment, the cover is a dual- or multi-layer cover including an inner or intermediate cover layer formed from an ionomeric composition and an outer cover layer formed from a polyurethane- or polyurea-based composition. The ionomeric layer preferably has a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer is preferably formed from a castable or reaction injection moldable polyurethane, polyurea, or copolymer or hybrid of polyurethane/polyurea. Such cover material is preferably thermosetting, but may be thermoplastic. The outer cover layer composition preferably has a material hardness of 85 Shore C or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

In another particular embodiment, the cover comprises an inner cover layer formed from an ionomeric composition and an outer cover layer formed from a thermosetting polyurethane- or polyurea-based composition. The inner cover layer composition preferably has a material hardness of from 60 or 62 or 65 Shore D to 65 or 70 or 72 Shore D. The inner cover layer preferably has a thickness within a range having a lower limit of 0.010 or 0.020 or 0.030 inches and an upper limit of 0.035 or 0.040 or 0.050 inches. The outer cover layer composition preferably has a material hardness of 62 Shore D or less, or less than 62 Shore D, or 60 Shore D or less, or less than 60 Shore D, or 55 Shore D or less, or less than 55 Shore D. The outer cover layer preferably has a thickness within a range having a lower limit of 0.010 or 0.020 or 0.025 inches and an upper limit of 0.035 or 0.040 or 0.050 inches.

In another particular embodiment, the cover comprises an inner cover layer formed from an ionomeric composition and an outer cover layer formed from a thermoplastic composition selected from ionomer-, polyurethane-, and polyurea-based compositions. The inner cover layer composition preferably has a material hardness of from 60 or 62 or 65 Shore D to 65 or 70 or 72 Shore D. The inner cover layer preferably has a thickness within a range having a lower limit of 0.010 or 0.020 or 0.030 inches and an upper limit of 0.035 or 0.040 or 0.050 inches. The outer cover layer composition preferably has a material hardness of 62 Shore D or less, or less than 62 Shore D, or 60 Shore D or less, or less than 60 Shore D, or 55 Shore D or less, or less than 55 Shore D. The outer cover layer preferably has a thickness within a range having a lower limit of 0.010 or 0.020 or 0.025 inches and an upper limit of 0.035 or 0.040 or 0.050 inches.

In another particular embodiment, the cover is a dual- or multi-layer cover including an inner or intermediate cover layer formed from an ionomeric composition and an outer cover layer formed from a polyurethane- or polyurea-based composition. The ionomeric layer preferably has a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer is preferably formed from a castable or reaction injection moldable polyurethane, polyurea, or copolymer or hybrid of polyurethane/polyurea. Such cover material is preferably thermosetting, but may be thermoplastic. The outer cover layer composition preferably has a material hardness of 85 Shore C or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

In the present invention, compression and CoR may also be tailored to suit desired playing characteristics. In this regard, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton, *Compression by Any Other Name, Science and Golf IV, Proceedings of the World Scientific Congress of Golf* (Eric Thain ed., Routledge, 2002) ("J. Dalton").

In a golf ball if the invention, Coefficient of Restitution or COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. COR is then calculated as the ratio of the outgoing transit time period to the incoming transit time period, $COR=V_{out}/V_{in}=T_{in}/T_{out}$. The COR value can be targeted, for example, by varying the core peroxide and antioxidant types and amounts as well as the cure temperature and duration.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

Hardness points should only be measured once at any particular geometric location.

The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores, cover layers, and the like); ball (or sphere) diameter; and the material composition of adjacent layers. It also should be understood that the two measurement techniques are not linearly related and, therefore, one hardness value cannot easily be correlated to the other.

A method or system of the invention may further incorporate indicia in a golf ball of the invention, which is considered herein to mean any symbol, letter, group of letters, design, or the like, that can be added to the dimpled surface of a golf ball.

It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any embodiment, the single-layer core may be replaced with a two or more layer core wherein at least one core layer has a hardness gradient. And the cover hardness may be targeted depending on desired playing characteristics. As a general rule, all other things being equal, a golf ball having a relatively soft cover will spin more than a similarly constructed ball having a harder cover.

And the cover hardness and the hardness of any intermediate layers may be targeted depending on desired playing characteristics. As a general rule, all other things being equal, a golf ball having a relatively soft cover will spin more than a similarly constructed ball having a harder cover.

It is understood that the method, system and golf balls of the invention as illustrated herein represent only some of the many possible embodiments of the inventive methods, systems and golf balls. It is appreciated by those skilled in the art that various changes and additions can be made to such golf balls without departing from the spirit and scope of this invention. It is intended that all such embodiments be covered by the appended claims.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the invention has been described herein with reference to particular means and materials, it is to be understood that the invention is not limited to the particulars disclosed and extends to all equivalents within the scope of the claims.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A method of coating an outer surface of a golf ball component comprising the steps of:

progressing the golf ball component within an enclosed chamber for a controlled duration of time;

at least partially covering the golf ball component with a coating material while the golf ball component is progressed within the enclosed chamber; and at least partially curing the coating material on the golf ball component within the enclosed chamber;

wherein the golf ball component is in a state of free fall while progressed within the enclosed chamber.

2. The method of claim 1, wherein the golf ball component is progressed within the enclosed chamber during the step of at least partially curing the coating material on the golf ball component.

3. The method of coating a golf ball of claim 1, wherein the step of progressing the golf ball component is preceded by a releasing step, wherein the golf ball component is introduced into the enclosed chamber by at least one of dropping, rolling or injecting the golf ball component through a top end without contacting an inner surface of the enclosed chamber.

4. The method of claim 1, wherein the coating material is selected from the group consisting of gas(es), powder(s), liquid(s), or combinations thereof.

5. The method of claim 4, wherein the coating material is applied onto the outer surface as an atomized spray.

6. The method of claim 1, wherein the coating material is selected from the group consisting of thermoset materials, thermoplastic materials, syntactic foams, or combinations thereof.

7. The method of claim 1, wherein the coating material forms a primer coat or a finishing coat about the golf ball component.

8. The method of claim 1, wherein the coating material covers the golf ball component entirely.

9. The method of claim 1, further comprising a step of heating an internal volume of the enclosed chamber to a temperature that softens or melts the coating material but does not soften or melt the golf ball component.

10. The method of claim 1, further comprising a step of heating the coating material prior to a step of providing the coating material into the enclosed chamber, to a temperature that softens or melts the coating material but does not soften or melt the golf ball component.

11. The method of claim 10, wherein the coating material is heated by a heat source consisting of at least one of a flame-based heat source, a gas-based heat source, or an electrical-based heat source.

12. The method of claim 11, wherein the heat source does not contact the outer surface of the golf ball component.

13. The method of claim 1, wherein the step of at least partially covering the golf ball component with the coating material and the step of at least partially curing the coating material on the golf ball component occur substantially simultaneously.

14. The method of claim 1, wherein the step of at least partially covering the golf ball component with the coating material and the step of at least partially curing the coating material on the golf ball component occur at least partially sequentially.

15. The method of claim 1, wherein the step of at least partially curing the coating material on the golf ball component comprises at least one of heating the coating material, exposing the coating material to airflow, or exposing the coating material to U.V. light.

16. The method of claim 1, wherein the step of at least partially curing the coating material precedes a further step wherein the golf ball component exits the enclosed chamber.

17. The method of claim 16, wherein the coating material is partially cured on the golf ball component before the golf ball component exits the enclosed chamber and is fully cured on the golf ball component before the golf ball component contacts another surface.

* * * * *